United States Patent [19]

Felkl et al.

[11] Patent Number: 4,864,931

[45] Date of Patent: Sep. 12, 1989

[54] FLEXIBLE PRINTING PLATE CLAMPING ASSEMBLY

[75] Inventors: Heinz W. Felkl; Karlheinz Antoni, both of Zell, Fed. Rep. of Germany

[73] Assignee: Koenig & Bauer Aktiengesellschaft, Würzburg, Fed. Rep. of Germany

[21] Appl. No.: 243,728

[22] Filed: Sep. 13, 1988

[51] Int. Cl.[4] ..... B41F 27/06

[52] U.S. Cl. ..... 101/415.1

[58] Field of Search ..... 101/415, 415.1, 407 R, 101/378, 409

[56] References Cited

U.S. PATENT DOCUMENTS

| | | | |
|---|---|---|---|
| 3,072,841 | 12/1961 | Autere et al. | 101/415.1 |
| 4,018,158 | 4/1977 | Borneman | 101/378 |
| 4,191,106 | 3/1986 | Fermi et al. | 101/415.1 |
| 4,347,788 | 9/1982 | Dufour | 101/415.1 |
| 4,367,679 | 1/1983 | Ishii | 101/415.1 |
| 4,493,258 | 1/1985 | Wallschlaeger et al. | 101/415.1 |
| 4,587,901 | 5/1986 | Gianfranco | 101/415.1 |
| 4,641,576 | 2/1987 | Guthling et al. | 101/415.1 |

FOREIGN PATENT DOCUMENTS 2808168 8/1979 Fed. Rep. of Germany .

*Primary Examiner*—Eugene H. Eickholt

*Attorney, Agent, or Firm*—Jones, Tullar & Cooper

[57] ABSTRACT

A flexible printing plate clamping assembly utilizes a circumferentially slidable support bar that has support edges which receive a leading edge of a printing plate. A camshaft is placed within a slot in the support bar such that rotation of the camshaft causes circumferential movement of the bar. Spring biased projections, carried on rotatable pipe shafts receive the trailing edge of the printing plate.

8 Claims, 2 Drawing Sheets

FLEXIBLE PRINTING PLATE CLAMPING ASSEMBLY

FIELD OF THE INVENTION

The present invention is directed generally to a flexible printing plate clamping assembly. More particularly, the present invention is directed to a flexible printing plate clamping assembly for a plate cylinder. Most specifically, the present invention is directed to a flexible printing plate clamping assembly for a plate cylinder of a rotary printing press. The leading edge of the flexible printing plate is engaged by a support edge of a cam actuated movable support bar. The trailing edge of the flexible printing plate is engaged by a spring loaded projection. The cam actuated movable support bar is slidable in a cylinder gap in a support housing which is located in a cylinder groove. This support bar can move circumferentially either in, or opposite to, the direction of rotation of the plate cylinder.

DESCRIPTION OF THE PRIOR ART

Flexible printing plates are typically clamped or otherwise attached to the circumferential surface of a plate or forme cylinder in a rotary printing press. In the prior art there are shown various printing plate clamping or holding arrangements which all are intended to hold the printing plate in place. One example of such a prior art device for clamping flexible printing plates to plate cylinders of rotary printing machines is the plate clamping assembly disclosed in German Published, Non-Examined patent application DE-OS 2808168. In this prior art printing plate clamping assembly, two movable support bars for beveled flexible printing plates are provided in a plate cylinder groove. One of them has a receptacle for a leading edge of a printing plate, the other a projection, prestressed by a torsion spring, for a trailing edge of a printing plate. A leaf spring is provided between the two support bars, and due to it's tension, tries to move the ends of the printing plate away from each other. Adjustment of the support bars for the circumferential indexing of the printing plate takes place by means of conehead screws which displace the support bars against the force of the leaf spring when they are screwed into the plate cylinder. However, the printing plate must have recesses in order to make the conehead screws accessible to a tool. Furthermore, fastening screws are provided for securing the support bars in a desired position, so that the support bars may be removably positioned on the base of the plate cylinder groove.

The printing plate clamping assembly disclosed in this prior art application does not allow a printing plate to be quickly clamped to the plate cylinder or to be quickly circumferentially indexed. This clearly requires a substantial amount of time. Further, since each of the support bars must be adjusted separately, there is a significant possibility that one or more of these screws will be adjusted differently from the rest thereby possibly skewing the printing plate which is being clamped to the plate cylinder. Such a skewing of the plate is clearly detrimental to the quality of the printed products.

An additional limitation of the plate clamping assembly, as disclosed in the prior art application and in similar such devices, is its lack of reversibility. Thus a plate cylinder provided with a typical prior art plate clamping device can only be rotated in one direction. This again limits the usability of the press.

It will thus be apparent that a need exists for a flexible printing plate clamping assembly in which the plate is quickly and accurately attachable to the plate cylinder, and which allows quick indexing of the plate. Further, a need exists for a plate clamping assembly which will allow the rotational direction of the plate cylinder to be reversed. The flexible printing plate clamping assembly of the present invention provides such a device.

SUMMARY OF THE INVENTION

It is an object of the present invention to provide a flexible printing plate clamping assembly.

Another object of the present invention is to provide a flexible printing plate clamping assembly for the clamping of printing plates to plate cylinders.

A further object of the present invention is to provide a flexible printing plate clamping assembly for clamping printing plates to a plate cylinder in a rotary printing press.

Yet another object of the present invention is to provide a flexible printing plate clamping assembly which will allow the direction of rotation of the plate cylinder to be reversed.

Still a further object of the present invention is to provide a flexible printing plate clamping assembly which facilitates quick clamping and circumferential indexing of the printing plate.

As will be discussed in greater detail in the description of the preferred embodiment, which is set forth subsequently, the flexible printing plate clamping assembly in accordance with the present invention utilizes a support bar which is circumferentially slidable in a gap in a support housing secured in a cylinder groove on the plate cylinder. The support bar carries spaced support edges that can hold an edge of the printing plate. A cam shaft is used to slide the support bar circumferentially with respect to the plate cylinder. A pair of spring biased projections are placed generally at the edges of the gap which houses the support bar. These projections can receive and hold a trailing edge of the plate.

The flexible printing plate clamping assembly in accordance with the present invention uses an elongated cam shaft to effect circumferential indexing or tensioning of the printing plate. Thus the printing plate will not become skewed on the plate cylinder so that printing quality will not be adversely affected. Additionally, the cam shaft is rotatable as a single unit so that the possible mis-adjustment of individual clamping screws, which has been a characteristic of prior art devices, is not possible with the present invention.

The flexible printing plate clamping assembly in accordance with the present invention is carried in a narrow cylinder groove which extends along the circumference of the printing plate cylinder generally parallel to the cylinder's axis of rotation. Since this groove is quite narrow in contrast to prior art devices, the amount of non-useable space on the periphery of the plate cylinder is kept to a minimum.

The flexible printing plate clamping assembly in accordance with the present invention provides a device which allows the rapid, accurate clamping and circumferential indexing of a printing plate to a plate cylinder. It requires little printing cylinder space and can be operated quickly and efficiently. It is substantially better than prior devices and is a significant advance in the art.

BRIEF DESCRIPTION OF THE DRAWINGS

While the novel feature of the flexible printing plate clamping assembly in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
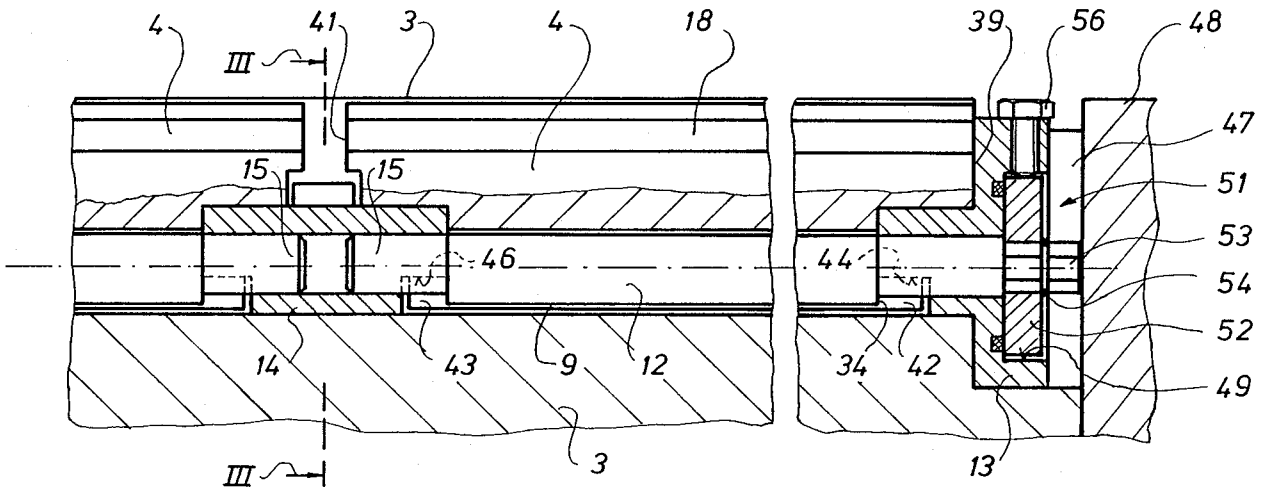
FIG. 1 is a side elevation view, partially in section of the flexible printing plate clamping assembly of the present invention and taken along the line I—I of FIG. 2.

Referring initially to FIG. 1, there may be seen a plate cylinder, generally at 1 which is supported in a generally conventional manner in side frames of a rotary printing press. The plate cylinder 1 has an axially extending, peripheral groove 2 which receives a support housing 3. The support housing 3 is securely fastened in the groove 2 and has an upwardly facing, axially extending cylinder gap 5. In the cylinder gap 5, there is positioned a support bar 4, which is slidable in, or opposed to, the direction of the rotation of the plate cylinder 1. Two spring-loaded projections 6 and 7, for securement of a following beveled trailing edge 8 of a printing plate 32, are also positioned in cylinder gap 5, as will be discussed in detail subsequently. It would also be possible to dispose two axially adjacent printing plate clamping devices 4, 6 and 7 in the cylinder gap 5.

A downwardly opening slot 11, which extends the length of the bar support 4, is provided in a base part 9 of the support bar 4. The slot 11 is used to receive a rotatable camshaft 12 which is supported in spaced end and intermediate bearing blocks 13 and 14, respectively. The camshaft 12 has a cam 34 which extends in an axial direction along the entire length of the camshaft 12. It would also be possible to eccentrically support a shaft for the adjustment of the support bar 4, the eccentricity of the shaft determining the amount of the adjustment path.

As depicted in FIG. 1 where there are shown several adjacent clamping assemblies 4, 6 and 7, two adjacent ends 15 of cam shafts 12 are supported in the intermediate bearing block 14 which has been screwed or otherwise fixedly attached to the bottom of the cylinder gap 5 in support housing 3.

The end bearing block 13 is disposed at one end of the plate cylinder 1 in a narrow gap 47 between the support bar 4 and a bearing ring 48 of the plate cylinder 1 and is also screwed to the plate cylinder 1. In a horizontal countersunk bore 49, the bearing block 13 has an adjusting and locking device 51. Locking device 51 includes a round disk 52 which is tightly yet rotatably positioned in the countersunk bore 49 of the bearing block 13. The disk is fixed on the right end of the camshaft 12, which is in the form of a hexagonal head 53, and is secured there by means of a retaining ring 54. The hexagonal head 53 of camshaft 12 extends beyond the bearing block 13 into the gap 47 so that it can be easily manipulated from above by a tool. A locking screw 56 secures the selected position of the camshaft 12 by engaging the surface of the round disk 52 to hold camshaft 12 in place once it has been positioned as desired.

Figure 2:
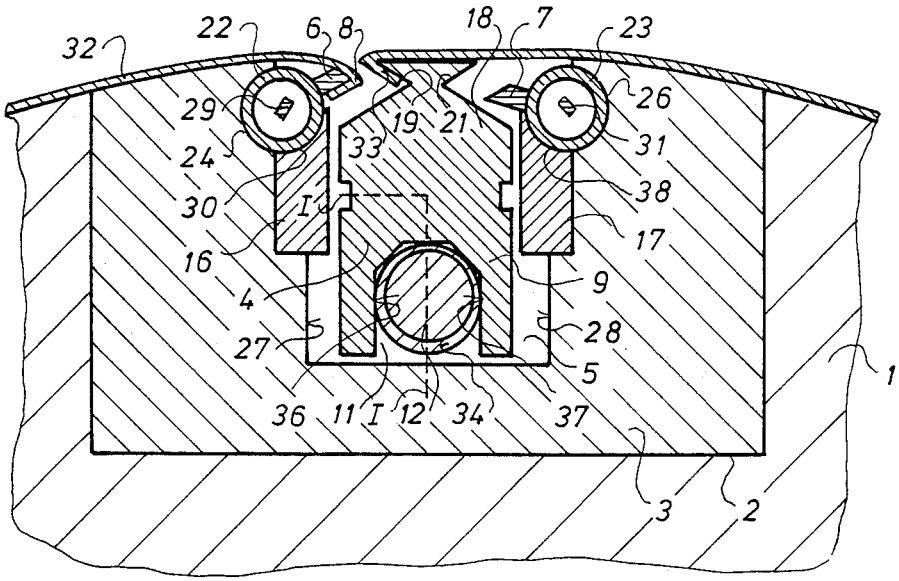
FIG. 2 is a cross-sectional view of the plate clamping assembly.
Figure 3:
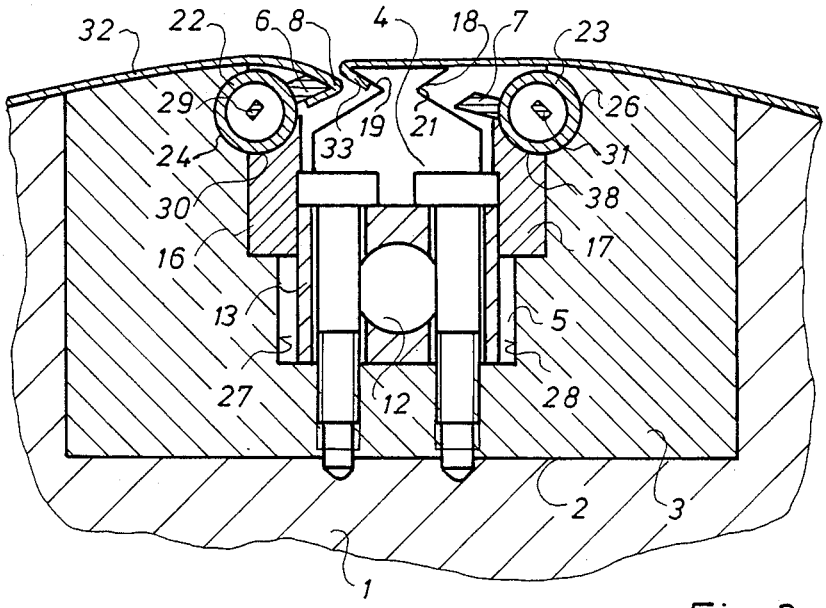
FIG. 3 is a cross-sectional view of the plate clamping assembly showing a bearing block assembly and taken along line III—III of FIG. 1.

A head or upper portion 18 of the support bar 4 has two opposed support edges 19 and 21. As may be seen most clearly in FIGS. 2 and 3, these support edges can receive the leading edge 33 of a printing plate 32 which is to be positioned on the plate cylinder 1.

The two opposing spring loaded or biased projections 6 and 7 are each fixed on a pivotable pipe shaft 22 and 23, respectively. The pipe shafts 22 and 23 are each supported in a half bearing bush 24 and 26, pointing in the direction of the cylinder groove 2, in left and right cylinder gap side wall 27 and 28, respectively, at the height of the support edges 19 and 21. To secure the pipe shafts 22 and 23 against falling out, mounting rails 16 and 17 are each screwed into a corresponding cylinder gap side wall 27 or 28. The mounting rails 16 and 17 each have a recess 30 or 38 corresponding to the radius of the pipe shaft 22 or 23 and, together with the half bearing bush 24 and 26, enclose three quarters of the circumference of the pipe shafts 22 and 23. Each of the pipe shafts 22 and 23 have, coaxially in their interiors, a torsion spring 29,31 and which is fastened in a known manner, such as shown in application DE-OS 2808168 to the pipe shaft 22 and 23 and to the plate cylinder 1.

Each support bar 4 has, at its opposing ends 39 and 41, shoulders 42 and 43, which are each pushed under a cooperating projection 44 or 46 of the bearing blocks 13 or 14 and in this matter form a horizontal guide, looking in the direction of rotation of plate cylinder 1, which prevents the support bar 4 from slipping out of the cylinder gap 5 in a vertical direction.

To clamp a printing plate 32 on the plate cylinder 1, a leading edge 33 of a printing plate 32 is hooked into one of the support edges 19 or 21, depending on the direction of the rotation of plate cylinder 1. The pipe shaft 22 or 23 is then pivoted against the force of the torsion spring 29 or 31 in the direction of rotation of the plate cylinder by means of a tool until the following trailing edge 8 of the printing plate 32 can be placed over the projection 6 or 7. The torsion spring 29 or 31, which has been prestressed by the pivoting movement, clamps the printing plate 32 to the plate cylinder 1 when the tool is released. In order to remove a printing plate 32 from the plate cylinder 1 the above described procedure is revised. The trailing edge 8 is removed from the projection 6 or 7 by rotation of the shaft 22 or 23 and the flexible printing plate 32 is unwrapped from about the periphery of the plate cylinder 1. The leading edge 33 of printing plate 32 can then disengaged from the support edge 19 or 21 of the head portion 18 of support bar 4.

To adjust the circumferential index of printing plate 32 on plate cylinder 1, the camshaft 12 is pivoted in, or in opposition to the direction of rotation of the plate cylinder 1 by means of a tool and is locked by means of the screw 56 in the desired position. The cam 34 of the camshaft 12 presses against a sidewall 36 or 37 of the downwardly facing slot 11 and thus displaces the leading edge 33 of the printing plate which is clamped in the support bar 4 against or with the aid of the elastic force of the torsion spring 29 and 31 which are acting on the trailing edge 8 of the printing plate, in or in opposition to the circumferential direction of rotation of the plate cylinder 1.

The flexible printing plate clamping assembly in accordance with the present invention will thus be seen as using a camshaft assembly to effect the circumferential indexing of the support bar 4 in the cylinder gap 5 provided in the support housing 3. The support bar 4 is thereby uniformly and accurately positionable in a manner that will not skew the printing plate 32 on plate cylinder 1. The camshaft 12 is rotatable by the use of a suitable tool which engages the head end 53 of the cam shaft so that the circumferential indexing of the printing plate is accomplished quickly and easily.

While a preferred embodiment of a flexible printing plate clamping assembly in accordance with the present invention has been set forth fully and completely above, it will be apparent to one of skill in the art that a number of changes in, for example, the overall size of the plate cylinder, the type of flexible printing plate being secured, and the like could be made without departing from the true sprit and scope of the present invention which is accordingly to be limited only by the following claims.

What is claimed is:

1. A flexible printing plate clamping and circumferential indexing assembly useable to secure and position a printing plate on a plate cylinder in a rotary printing press, said flexible printing plate clamping assembly comprising:

a support bar having spaced first and second support edges for selective receipt of a leading edge portion of the flexible printing plate, said support bar being positioned in a gap in the plate cylinder and being slideably shiftable circumferentially in said gap selectively in, and in opposition to, the direction of rotation of the plate cylinder to concurrently slide both of said first and second spaced support edges in the same circumferential direction in said gap;

a projection in said gap for receipt of a trailing edge of the flexible printing plate; and a rotatable camshaft supported in said gap in contact with said support bar, rotation of said camshaft effecting said circumferential sliding of said support bar in said gap.

2. The flexible printing plate clamping assembly of claim 1 wherein said camshaft is engageable with spaced sidewalls of a downwardly opening slot in said support bar.

3. The flexible printing plate clamping assembly of claim 1 wherein said support bar has a head portion, said head portion having said first and second spaced support edges, each of said support edges being usable to receive said leading edge portion of the flexible printing plate.

4. The flexible printing plate clamping assembly of claim 3 wherein first and second spaced flexible printing plate trailing edge receiving projections are placed generally adjacent said first and second spaced support edges.

5. The flexible printing plate clamping assembly of claim 2 wherein said camshaft is rotatably supported in said gap by spaced bearing blocks.

6. The flexible printing plate clamping assembly of claim 5 wherein an end of said camshaft carries a round disk in a bore in said bearing block and a head adjacent said bearing block, said head being engageable by a tool to rotate said camshaft.

7. The flexible printing plate clamping assembly of claim 6 wherein a locking screw is positionable in said bearing block and is engageable with said round disk to secure said camshaft in a selected position.

8. A flexible printing plate clamping assembly usable to secure a printing plate on a plate cylinder in a rotary printing press, said flexible printing plate clamping assembly comprising:

a support bar for receipt of a leading edge portion of the flexible printing plate, said support bar being positioned in a gap in the plate cylinder and being circumferentially slidable in said gap selectively in, and in opposition to, the direction of rotation of the plate cylinder;

a projection in said gap for receipt of a trailing edge of the flexible printing plate; and a rotatable camshaft supported in said gap by spaced bearing blocks and operable to effect said circumferential sliding of said support bar, said camshaft being in engagement with spaced sidewalls of a downwardly opening slot in said support bar and having an end which carries a round disk in a bore in said bearing block and a head adjacent said bearing block, said head being engageable by a tool to rotate said camshaft, said bearing block receiving a locking screw which is engageable with said round disk to secure said camshaft in a selected position.

* * * * *